US008398434B2

(12) United States Patent
Davis et al.

(10) Patent No.: US 8,398,434 B2
(45) Date of Patent: Mar. 19, 2013

(54) CONNECTOR ASSEMBLY

(75) Inventors: Wayne Samuel Davis, Harrisburg, PA (US); Robert Neil Whiteman, Jr., Middletown, PA (US); Timothy R. Minnick, Enola, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 258 days.

(21) Appl. No.: 13/007,929

(22) Filed: Jan. 17, 2011

(65) Prior Publication Data

US 2012/0184140 A1 Jul. 19, 2012

(51) Int. Cl.
*H01R 13/648* (2006.01)

(52) U.S. Cl. ..... 439/607.34

(58) Field of Classification Search ..... 439/607.34, 439/79, 941, 947, 607.3, 607.05–607.07, 439/607.09, 607.11–607.13, 607.17–607.18, 439/541.5

See application file for complete search history.

(56) References Cited

U.S. PATENT DOCUMENTS

| | | | | |
|---|---|---|---|---|
| 5,735,712 | A * | 4/1998 | Haas et al. | 439/607.28 |
| 6,852,924 | B2 | 2/2005 | Lessard | |
| 7,775,802 | B2 * | 8/2010 | Defibaugh et al. | 439/65 |
| 7,789,676 | B2 * | 9/2010 | Morgan et al. | 439/79 |

* cited by examiner

*Primary Examiner* — Edwin A. Leon

(57) ABSTRACT

A connector assembly includes contact modules each having a dielectric frame and contacts held by the dielectric frame. The contacts are arranged along a contact plane within the frame. The dielectric frame includes frame members connected by connecting segments. The frame has windows between the frame members located between adjacent contacts. Holders support corresponding contact modules. The holders are electrically grounded. The holders each have a support wall and tabs that extend outward from the support wall. The contact modules are coupled to the holders such that the tabs are received in the windows to provide shielding within the contact modules. The holders are coupled together such that the contact modules are stacked together with the tabs of at least some of the holders that extend into the contact module held by the adjacent holder and across the contact plane defined by the contact module of the adjacent holder.

20 Claims, 7 Drawing Sheets

CONNECTOR ASSEMBLY

BACKGROUND OF THE INVENTION

The subject matter herein relates generally to grounding connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. The connection between the ground contacts typically has ends of the ground contacts overlapping by a distance to create an electrical stub, which affects the electrical performance of the system.

A need remains for an electrical system that provides efficient shielding to meet particular performance demands.

BRIEF DESCRIPTION OF THE INVENTION

In one embodiment, a receptacle assembly is provided having a front housing having signal contact openings and ground contact openings. Contact modules are coupled to the front housing. The contact modules have a plurality of signal contacts that are received in corresponding signal contact openings of the front and that are configured to be mated with corresponding signal contacts of a header assembly. The contact modules have a shield body that provides electrical shielding along the signal contacts. The shield body has a mating interface. A conductive gasket is positioned between the front housing and the contact module. The conductive gasket engages the mating interface of at least one of the contact modules. The conductive gasket is configured to provide a ground path between the at least one of the contact modules and a ground contact of the header assembly which is configured to extend through the ground contact opening to directly engage the conductive gasket.

In another embodiment, an electrical connector assembly is provided including a header assembly having a header housing holding header signal contacts and header ground contacts that have front edges. The electrical connector assembly also includes a receptacle assembly mated with the header assembly. The receptacle assembly includes a contact module having receptacle signal contacts mated with corresponding header signal contacts. The contact module has a shield body providing electrical shielding for the receptacle signal contacts that has a mating interface. The receptacle assembly has a conductive gasket having a first side and a second side. The first side engages the mating interface of the shield body and the second side engages the front edges of the header ground contacts. The conductive gasket provides a ground path between the contact module and the header ground contacts.

In a further embodiment, an electrical connector assembly includes a header assembly having a header housing holding header signal contacts and header ground contacts and a receptacle assembly mated with the header assembly. The receptacle assembly includes contact modules having a plurality of receptacle signal contacts. The contact modules have shield bodies providing electrical shielding for the receptacle signal contacts. The shield bodies have mating interfaces. The receptacle assembly includes a front housing holding the contact modules. The front housing has signal contact openings receiving the receptacle signal contacts and the header signal contacts. The receptacle signal contacts are mated with corresponding header signal contacts within the front housing. The front housing has ground contact openings receiving corresponding header ground contacts. At least one conductive gasket is positioned between the front housing and the contact module. The conductive gaskets engage corresponding mating interfaces of the contact modules and corresponding header ground contacts engage the conductive gaskets. The conductive gaskets provide a ground path between the contact modules and corresponding header ground contacts.

DETAILED DESCRIPTION OF THE INVENTION

Figure 1:
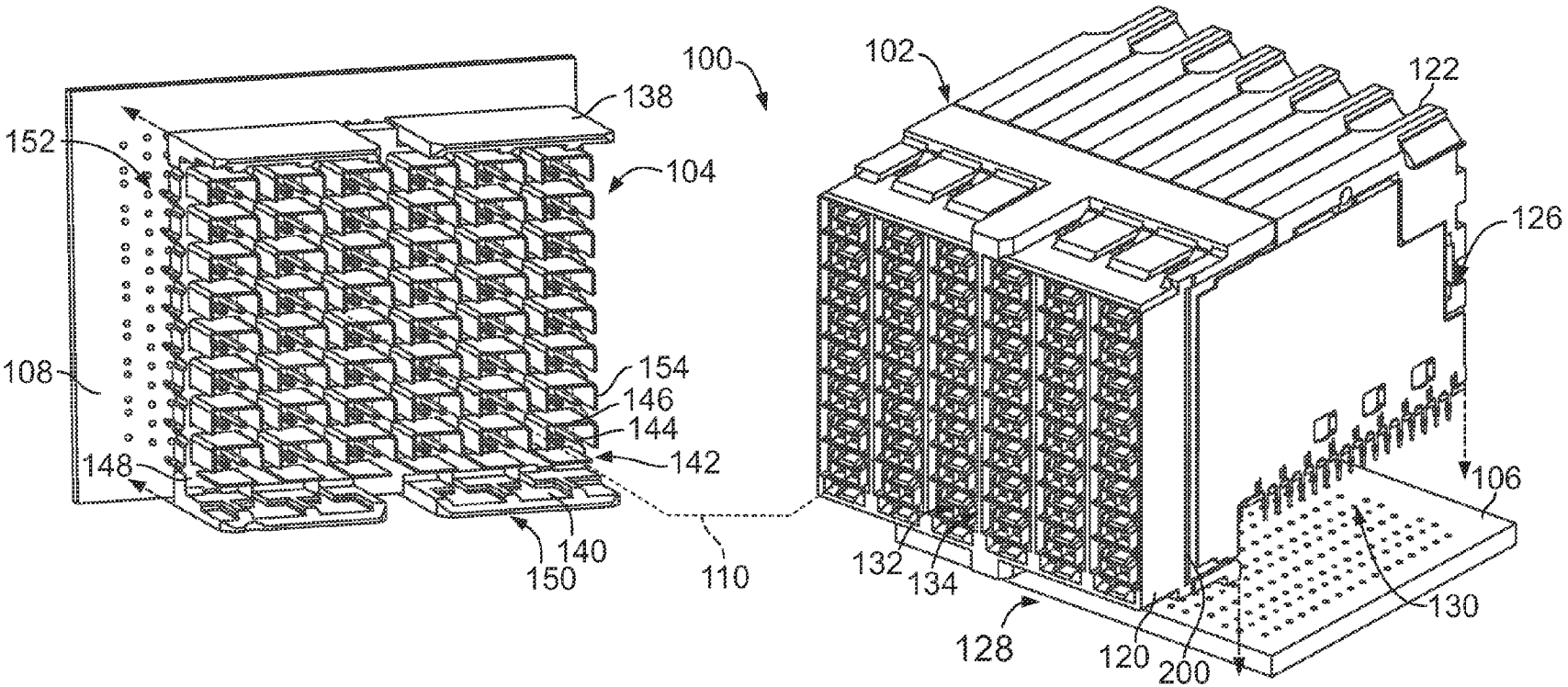
FIG. 1 is a perspective view of an exemplary embodiment of a connector system illustrating a receptacle assembly and a header assembly.

FIG. 1 is a perspective view of an exemplary embodiment of a connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield body 126 for providing electrical shielding for the receptacle signal contacts 124. In an exemplary embodiment, the shield body 126 is electrically connected to the header assembly 104 and/or the circuit board 106. For example, the shield body 126 may be electrically connected to the header assembly 104 by a conductive gasket 200 held by the receptacle assembly 102. The shield body 126 may be electrically connected to the circuit board 106 by a similar gasket or by other means, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header ground contacts 146 therein when the receptacle and header assemblies 102, 104 are mated. The header ground contacts 146 engage the conductive gasket 200 when the receptacle and header assemblies 102, 104 are mated to electrically connect the header ground contacts 146 to the shield body 126 of the corresponding contact module 122.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header ground contacts 146. The front housing 120 isolates each set of receptacle and header signal contacts 124, 144 from other sets of receptacle and header signal contacts 124, 144

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header ground contacts 146 extend from a base wall 148 into the chamber 142. The header signal contacts 144 and the header ground contacts 146 extend through the base wall 148 and are mounted to the circuit board 108.

In an exemplary embodiment, the header signal contacts 144 are arranged as differential pairs. The header ground contacts 146 are positioned between the differential pairs to provide electrical shielding between adjacent differential pairs. In the illustrated embodiment, the header ground contacts 146 are C-shaped and provide shielding on three sides of the pair of header signal contacts 144. The header ground contact 146 associated with another pair of header signal contacts 144 provides the shielding along the fourth side thereof such that each of the pairs of signal contacts 144 are shielded from the adjacent pair in the same column and the same row. Other configurations or shapes for the header ground contacts 146 are possible in alternative embodiments, such as L-shaped ground contacts, flat or planar contacts, individual pin-type contacts, spring beam type contacts, and the like. In other alternative embodiments, walls of the header housing 138 may be positioned between the pairs of signal contacts 144 where the walls are conductive and provide electrical shielding. In other alternative embodiments, the header ground contacts 146 may provide shielding to individual signal contacts 144 or sets of contacts having more than two signal contacts 144.

The header ground contacts 146 extend to edges 154. The edges 154 engage the conductive gasket 200 when the header ground contacts 146 are received in the ground contact openings 134 to electrically connect the header ground contacts 146 with the shield bodies 126.

Figure 2:
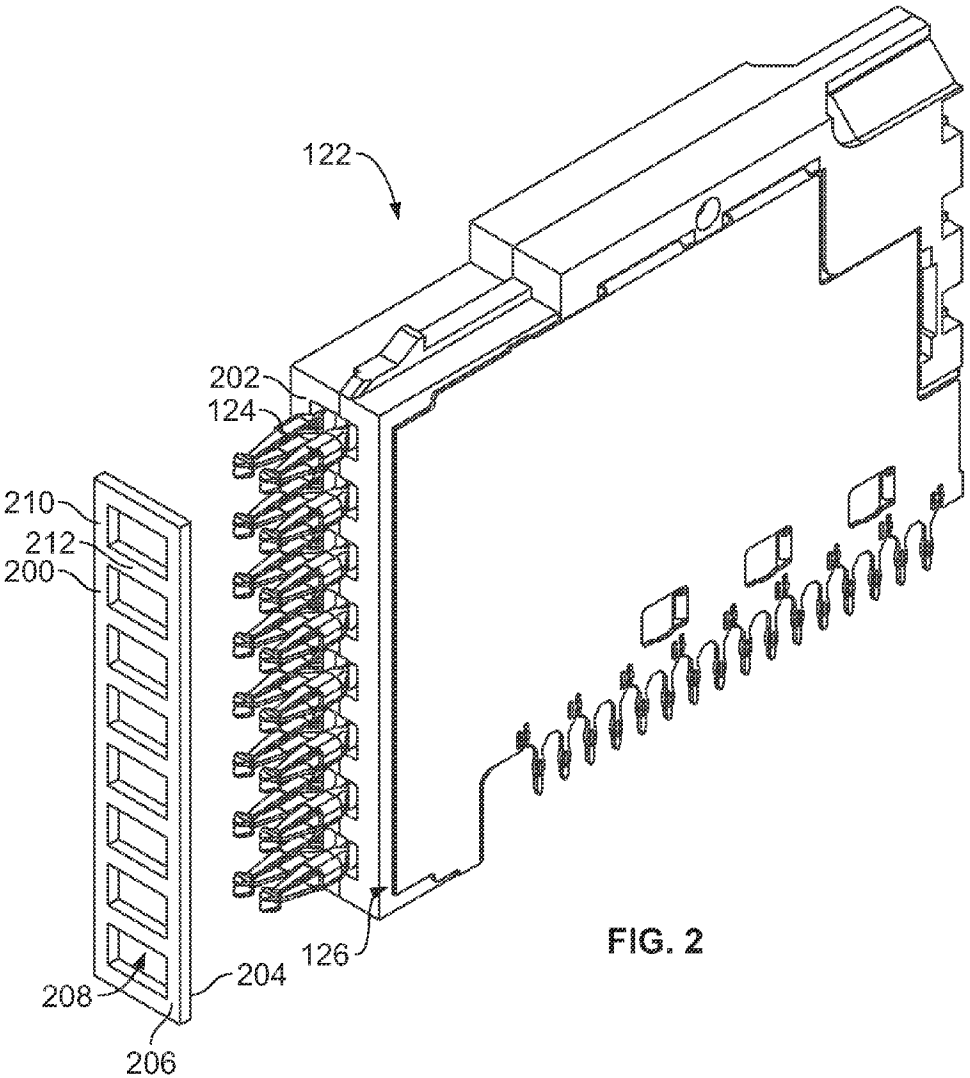
FIG. 2 is an exploded view of a contact module for the receptacle assembly showing a conductive gasket poised for mounting to the contact module.

FIG. 2 is an exploded view of one of the contact modules 122 showing one of the conductive gaskets 200 poised for mounting to the contact module 122. The conductive gasket 200 may be similar to the conductive gasket described in U.S. patent application Ser. No. 13/007,944 , titled "CONNECTOR ASSEMBLY", the complete subject matter of which is herein incorporated by reference in its entirety.

The conductive gasket 200 defines a ground path between the shield body 126 of the contact module 122 and the header ground contacts 146 (shown in FIG. 1). For example, the conductive gasket 200 may engage, and be electrically connected to, the shield body 126.

The shield body 126 includes a generally planar mating interface 202 at a front of the contact module 122. The conductive gasket 200 is secured to the mating interface 202, such as using conductive adhesive, conductive epoxy, securing features such as tabs or latches, and the like. Alternatively, the conductive gasket 200 rests on the mating interface 202 and is sandwiched between the shield body 126 and the front housing 120.

The conductive gasket 200 includes a planar body having a first side 204 and a second side 206. The conductive gasket 200 may be fabricated from a compressible material that is compressed when the header assembly 104 is mated with the receptacle assembly 102. For example, the conductive gasket 200 may be an elastomeric sheet that is compressible to define a compressible interface between the shield body 126 and the header ground contacts 146. The elastomeric sheet is conductive to define a conductive pathway between the first and second sides 204, 206. The conductive gasket 200 may be fabricated from a compliant plastic or rubber material having conductive filler, a conductive plating, a conductive coating and the like. Alternatively, the conductive gasket 200 may be fabricated from a conductive fabric, such as a woven mesh. In other alternative embodiments, the conductive gasket 200 may be fabricated from a metallic plate, metallic strips, or a metallic mold or die. In such embodiments, the conductive gasket 200 may include compressible elements such as spring fingers to ensure contact between the conductive gasket 200 and the shield body 126 and/or the header ground contacts 146. Alternatively, rather than being planar, the conductive gasket 200 may have another shape, such as a stepped interface for use with a non-planar shield body 126.

The conductive gasket 200 includes a plurality of openings 208 extending therethrough defined by vertical framepieces 210 and horizontal framepieces 212. In the illustrated embodiment, the openings 208 are aligned in a single column for use with one contact module 122. In alternative embodiments, the conductive gasket 200 may include multiple columns for use with multiple contact modules 122. In other alternative embodiments, the conductive gasket 200 may include a single opening, such as an opening extending around one pair of signal contacts 124 or an opening extending around multiple pairs of signal contacts 124.

Figure 3:
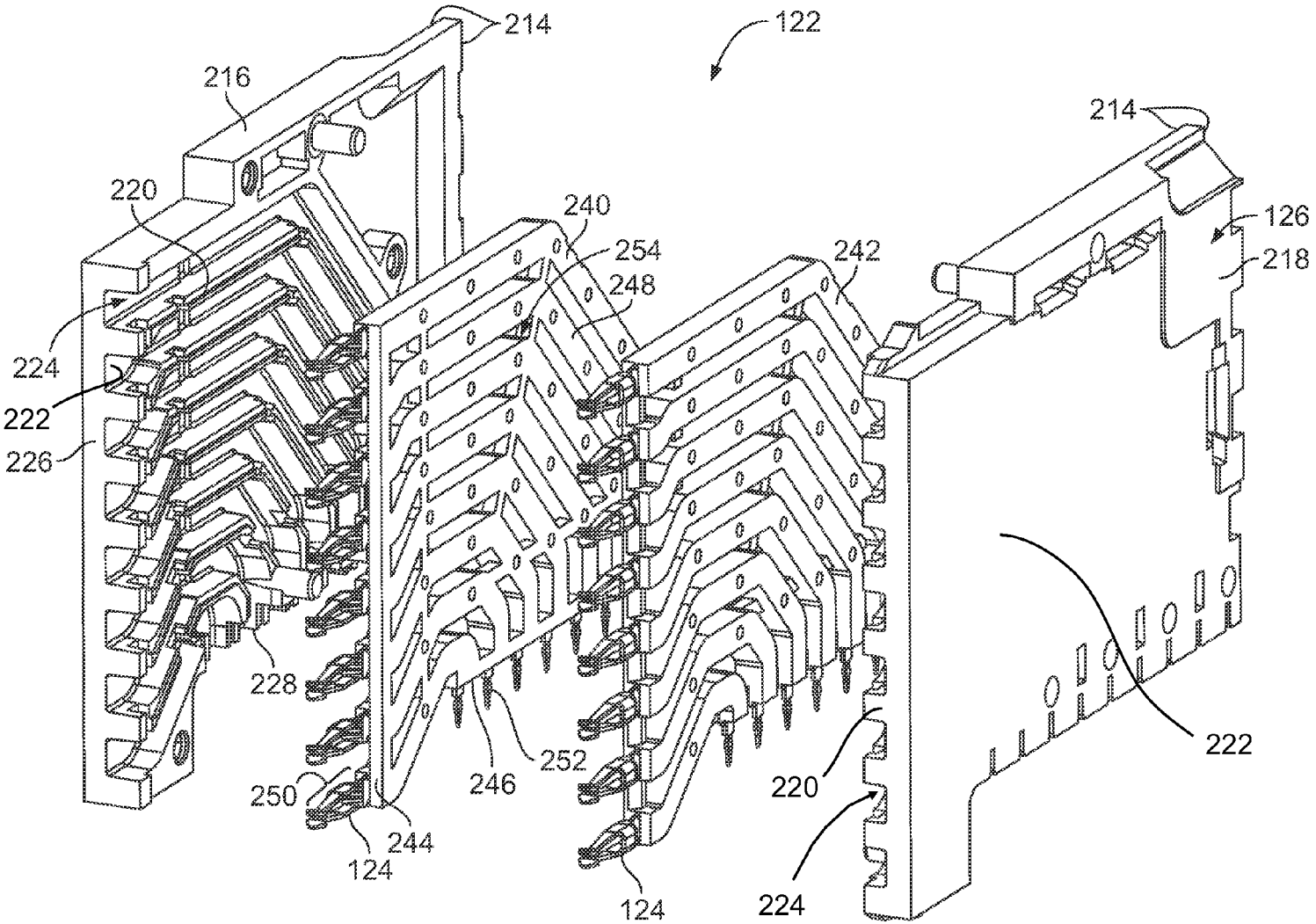
FIG. 3 is an exploded view of a contact module.

FIG. 3 is an exploded view of one of the contact modules 122. The contact module 122 includes a holder 214 having a first holder member 216 and a second holder member 218 that are coupled together to form the holder 214. The holder members 216, 218 are fabricated from a conductive material. For example, the holder members 216, 218 may be die-cast from a metal material. Alternatively, the holder members 216, 218 may be stamped and formed or may be fabricated from a plastic material that has been metalized or coated with a metallic layer. By having the holder members 216, 218 fabricated from a conductive material, the holder members 216, 218 may provide electrical shielding for the receptacle assembly 102. When the holder members 216, 218 are coupled together, the holder members 216, 218 define at least a portion of the shield body 126 of the receptacle assembly 102.

The holder members 216, 218 include tabs 220 extending inward from a side wall 222 thereof. The tabs 220 define channels 224 therebetween. The tabs 220 and channels 224 extend between mating interfaces 226 and mounting interfaces 228 of the holder members 216, 218. The mating interfaces 226 may define part of the mating interface 202 (shown in FIG. 1) of the shield body 126 (shown in FIG. 1).

The contact module 122 includes a pair of dielectric frames 240, 242 surrounding the receptacle signal contacts 124. In an exemplary embodiment, the receptacle signal contacts 124 are initially held together as a lead frame (not shown), which is overmolded with a dielectric material to form the dielectric frames 240, 242. Other manufacturing processes may be utilized to form the contact modules 122 other than overmolding a lead frame, such as loading receptacle signal contacts 124 into a formed dielectric body.

The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. In other embodiments, the mating portions 250 may be non-perpendicular with respect to the contact tails 252. For example, the mating portions 250 may be parallel to the contact tails 252. Optionally, the mating portions 250 may be axially aligned with the contact tails 252. The frame members 248 are elongated and generally follow the paths of the receptacle signal contacts 124 between the contact tails 252 and the mating portions 250.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the dielectric frames 240, 242 and corresponding receptacle signal contacts 124 are coupled to the holder members 216, 218, respectively. The frame members 248 are received in corresponding channels 224. The tabs 220 are received in corresponding windows 254 such that the tabs 220 are positioned between adjacent receptacle signal contacts 124. The holder members 216, 218 provide electrical shielding between and around respective receptacle signal contacts 124. The holder members 216, 218 provide shielding from electromagnetic interference (EMI) and/or radio frequency interference (RFI). The holder members 216, 218 may provide shielding from other types interference as well. The holder members 216, 218 provide shielding around the outside of the frames 240, and thus around the outside of all of the receptacle signal contacts 124, as well as between the receptacle signal contacts 124 using the tabs 220 to control electrical characteristics, such as impedance control, crosstalk control, and the like, of the receptacle signal contacts 124.

Figure 4:
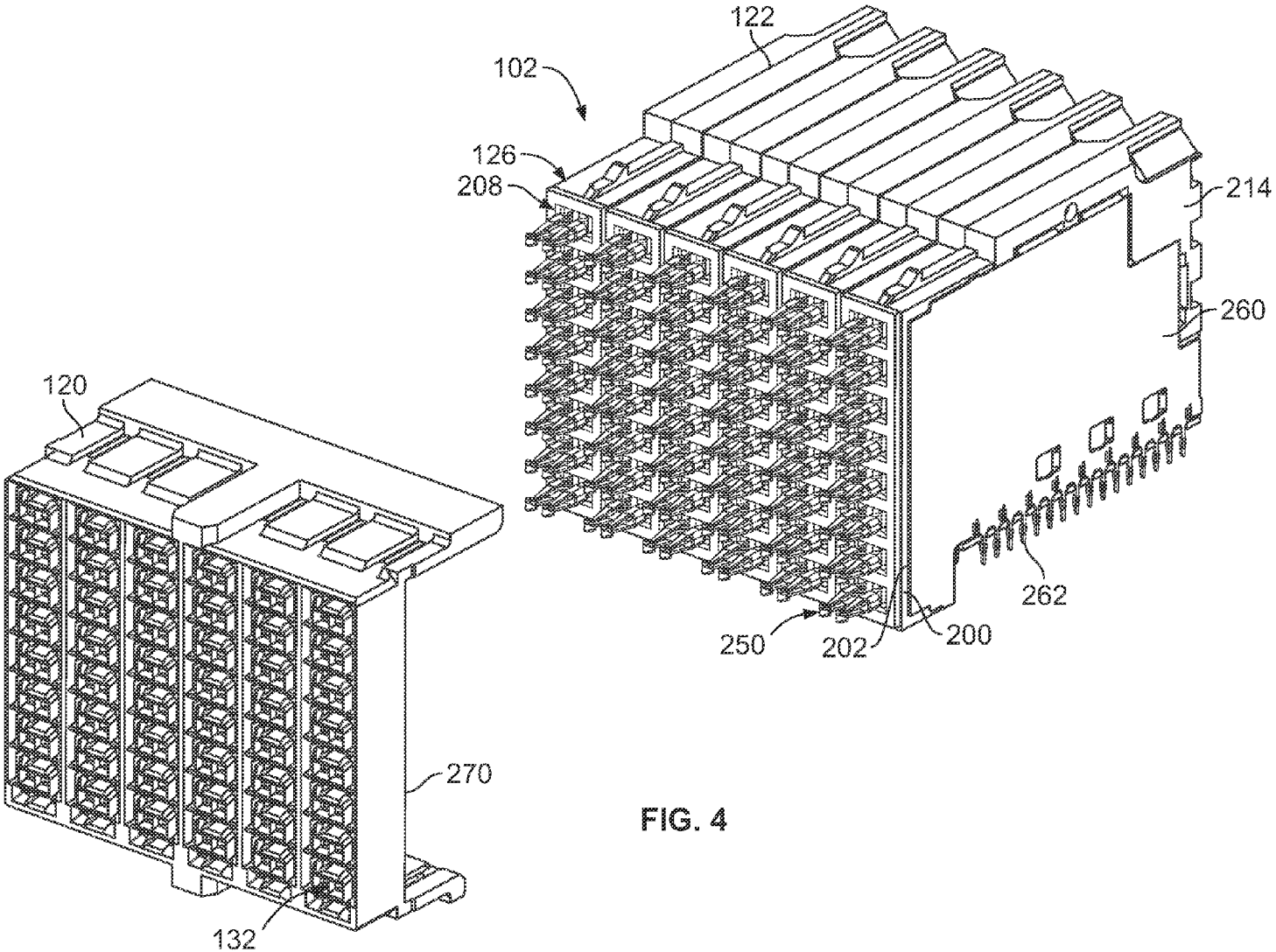
FIG. 4 is a front perspective view of the receptacle assembly with the contact modules thereof poised for loading into a front housing of the receptacle assembly.

FIG. 4 is a front perspective view of the receptacle assembly 102 with the contact modules 122 poised for loading into the front housing 120. The conductive gaskets 200 are coupled to the shield bodies 126 defined by contact modules 122. The conductive gaskets 200 are configured to be engaged by, and electrically connected to, the header ground contacts 146 (shown in FIG. 1). The conductive gaskets 200 define an electrical path between the header ground contacts 146 and the shield bodies 126.

In an exemplary embodiment, the holders 214 define at least portions of the shield bodies 126. The holders 214 are manufactured from a conductive material and provide electrical shielding around the receptacle signal contacts 124. The holders 214 are configured to be electrically connected to a ground plane of the circuit board 106 (shown in FIG. 1) using grounding shields 260 coupled to corresponding holders 214. The grounding shields 260 are metal plates that engage and are electrically connected to the holders 214. The grounding shields 260 include ground pins 262 extending therefrom that are configured to be received in plated ground vias of the circuit board 106. The grounding shields 260 form part of the shield body 126.

In an alternative embodiment, rather than using the grounding shields 260, the holders 214 may be electrically connected to the ground plane of the circuit board 106 by alternative means. For example, another conductive gasket may be positioned between the holders 214 and the circuit board 106 to create a conductive pathway therebetween.

In another alternative embodiment, rather than the holders 214 defining part of the shield body, the grounding shields 260 may define the shield body. The holders 214 may be non-conductive, such as plastic parts that hold the grounding shields 260. The grounding shields 260 may engage the conductive gasket 200 at one end and the circuit board 106 at the other end to define a conductive pathway between the conductive gasket 200 and the circuit board 106.

In the illustrated embodiment, each contact module 122 has a separate conductive gasket 200 coupled thereto. Alternatively, a single conductive gasket may be coupled to all of the contact modules 122. In other alternative embodiments, the conductive gasket(s) 200 may be coupled to the front housing 120 rather than to the contact modules 122.

During assembly, the contact modules 122 are loaded into the front housing 120 such that the conductive gaskets 200 are positioned between a rear end 270 of the front housing 120 and the mating interface 202 of the shield body 126. The mating portions 250 extend forward from the holders 214 and are loaded into the signal contact openings 132. The mating portions 250 extend through corresponding openings 208 in the conductive gaskets 200.

Figure 5:
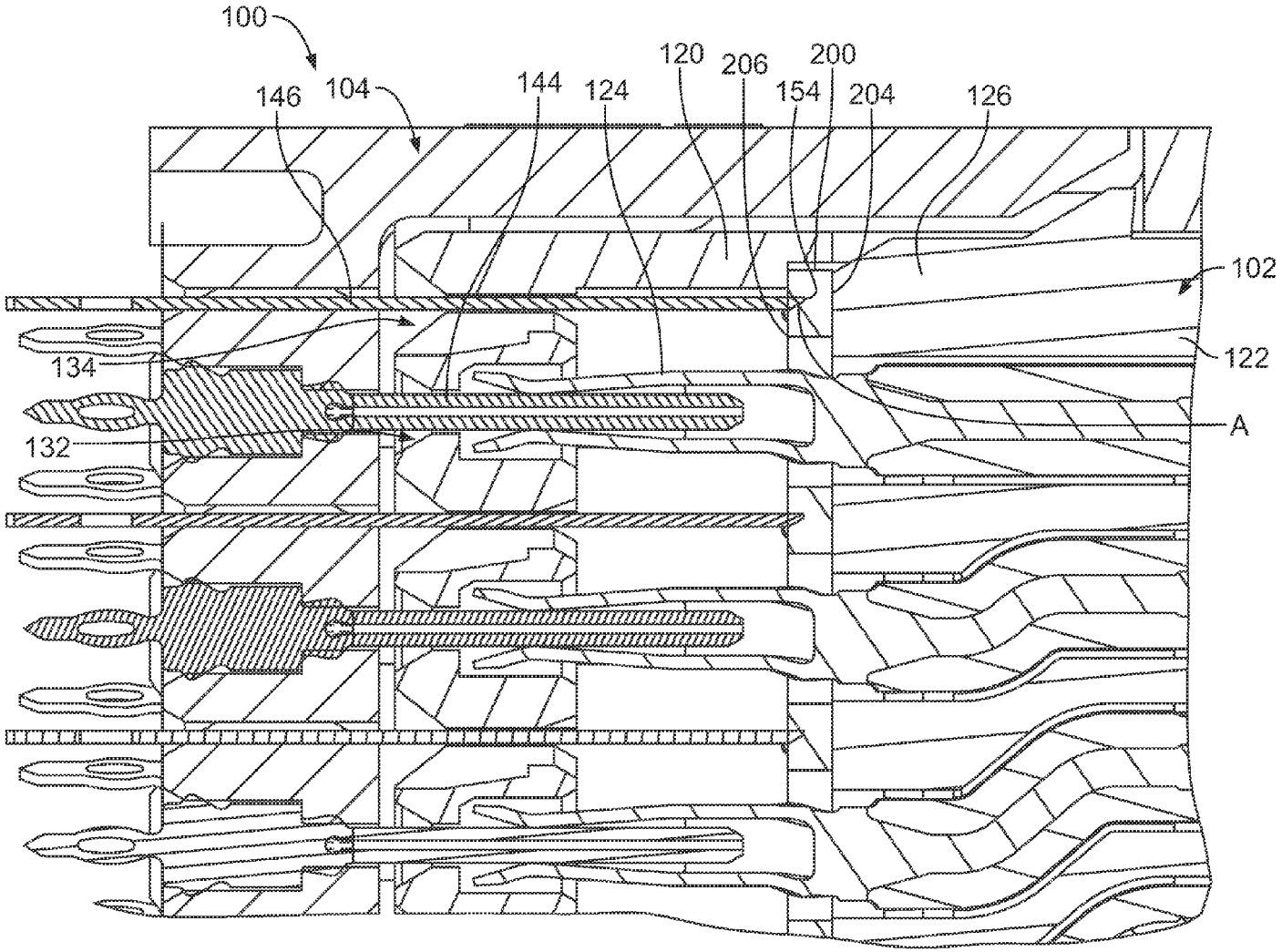
FIGS. 5 and 6 are cross-sectional views of a portion of the connector system showing the receptacle assembly mated with the header assembly.
Figure 6:
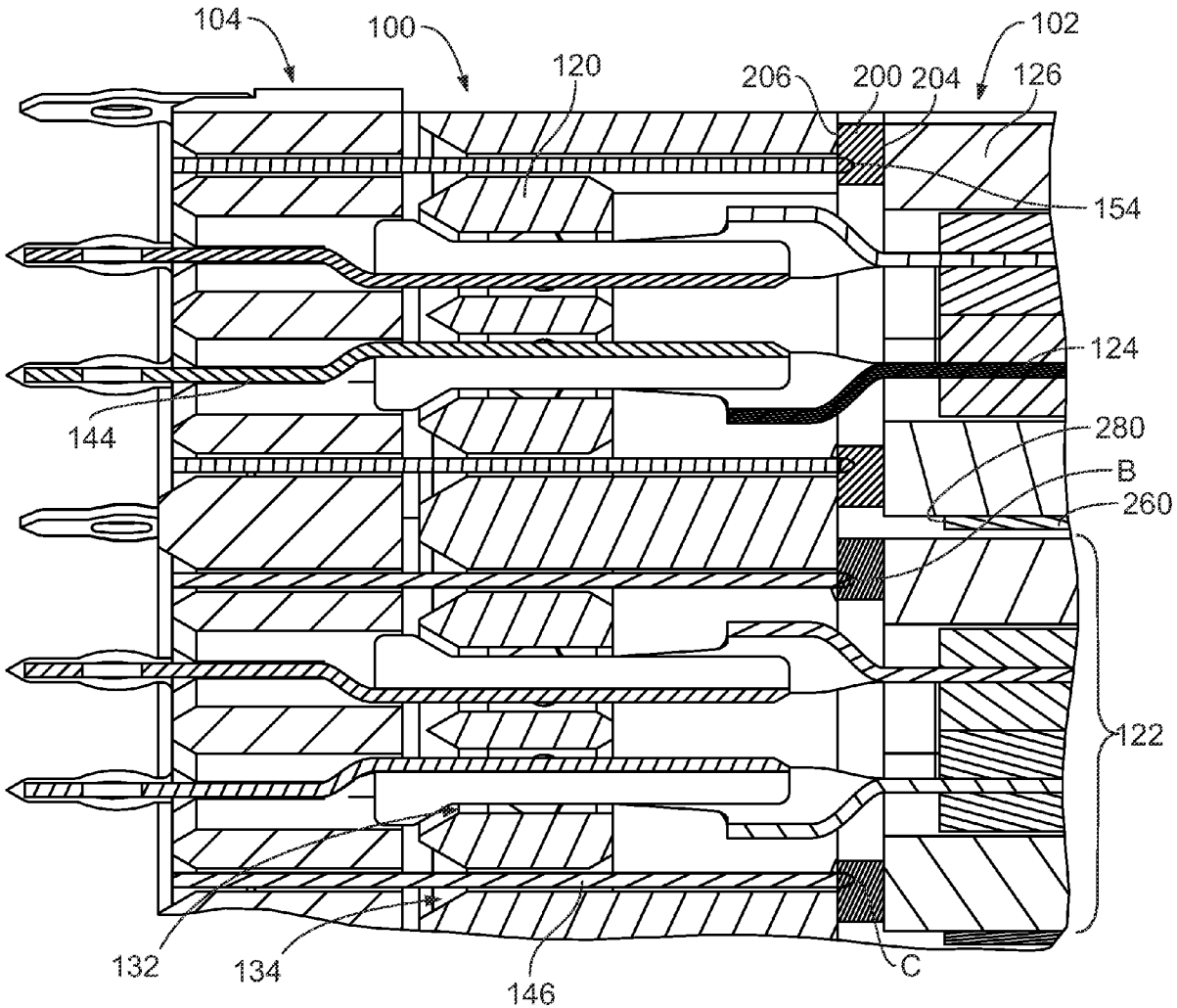

FIGS. 5 and 6 are vertical and horizontal cross-sectional views, respectively, of a portion of the connector system 100 showing the receptacle assembly 102 mated with the header assembly 104. The conductive gasket 200 is positioned between the front housing 120 and the shield body 126 of the contact module 122. The first side 204 of the conductive gasket 200 engages the shield body 126.

The receptacle signal contacts 124 and the header signal contacts 144 extend into the signal contact openings 132 of the front housing 120 and are mated to one another within the signal contact openings 132. The header ground contacts 146 extend through the ground contact openings 134 of the front housing 120 such that the edges 154 engage the second side 206 of the conductive gasket 200. By having the edge 154 engage the conductive gasket 200, electrical ground stubs are eliminated as the forward-most point of the header ground contact 146 forms the conductive ground path. No spring beam or other ground element (such as from the grounding shield 260) extends along the surface of the header ground contact 146, as with conventional connector systems. The interface between the header ground contact 146 and the conductive gasket 200, as well as the interface between the conductive gasket 200 and the shield body 126 provides a straight line ground connection and eliminates electrical ground stubs. Additionally, as shown in FIGS. 5 and 6, the C-shaped header ground contact 146 fully engages the conductive gasket 200 along both the top (at A) and along both sides (at B and C) of the C-shaped header ground contact 146.

The conductive gasket 200 may be at least partially compressed between the header ground contacts 146 and the shield body 126 to ensure electrical connection to both the header ground contacts 146 and the shield body 126. Optionally, a front edge 280 of the grounding shield 260 may engage the first side 204 of the conductive gasket 200 to directly connect the grounding shield to the conductive gasket 200. For example, the front edge 280 may extend to or beyond the mating interfaces 226 of the holder members 216, 218 (shown in FIG. 3) to engage the conductive gasket 200.

Figure 7:
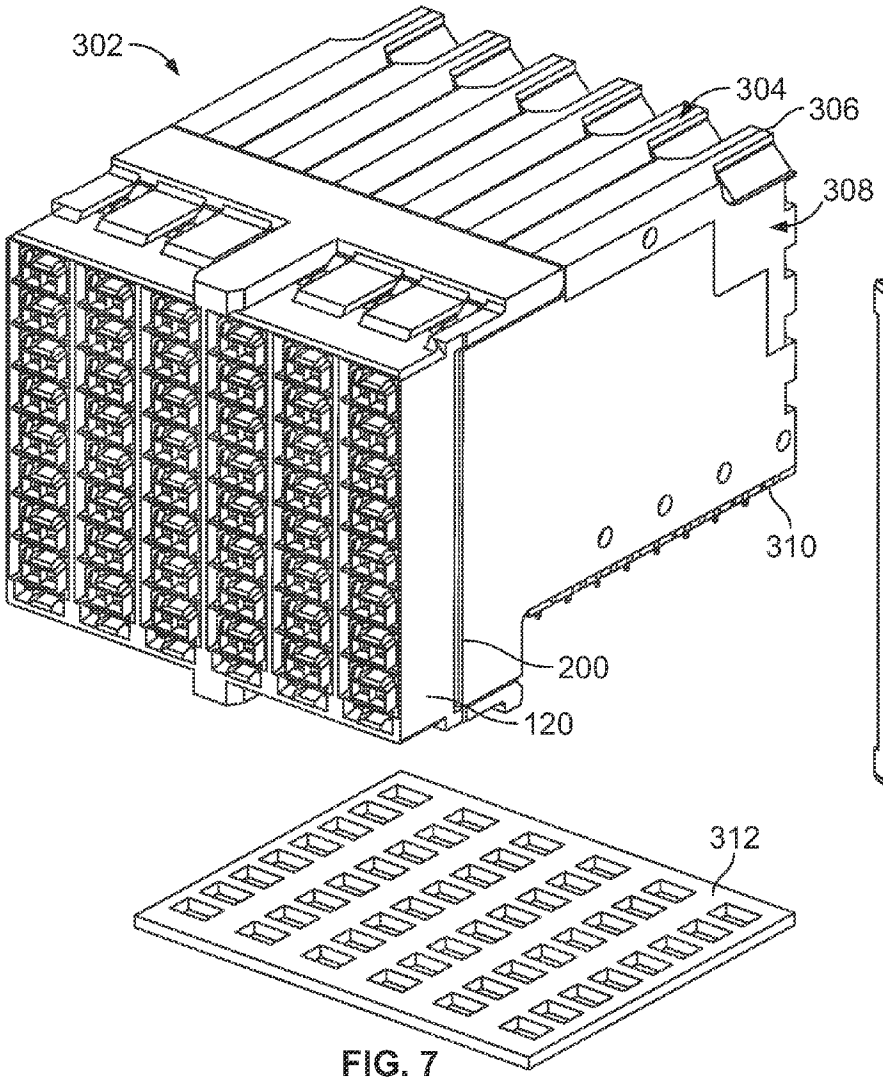
FIG. 7 illustrates an alternative receptacle assembly formed in accordance with an exemplary embodiment.

FIG. 7 illustrates an alternative receptacle assembly 302 formed in accordance with an exemplary embodiment. The receptacle assembly 302 is similar to the receptacle assembly 102 (shown in FIG. 1), however the receptacle assembly 302 does not include a grounding shield for making an electrical connection with a circuit board (not shown). Rather, the receptacle assembly 302 includes contact modules 304 having conductive holders 306 that define shield bodies 308. The shield bodies 308 have mounting interfaces 310 at a bottom of the contact modules 304. A conductive gasket 312 is configured to be connected to the mounting interfaces 310 between the contact modules 304 and the circuit board. The conductive gasket 312 defines a conductive path between the contact modules 304 and a ground plane of the circuit board. The conductive gasket 200 is used between the front housing 120 and the contact modules 304.

In another alternative embodiment, the receptacle assembly may have a different type of mating interface, with the conductive gasket provided at the mating interface for creating a ground path through the receptacle assembly. For example, the receptacle assembly may be a card edge connector having a slot configured to receive an edge of a circuit board. A conductive gasket may be held by the receptacle assembly and engage ground pads on the circuit board plugged into the receptacle assembly. The conductive gaskets may be used on other types of connectors as well to form a conductive path between the connector and another component, be it another connector, a circuit board, or another electronic component or device.

Figure 8:
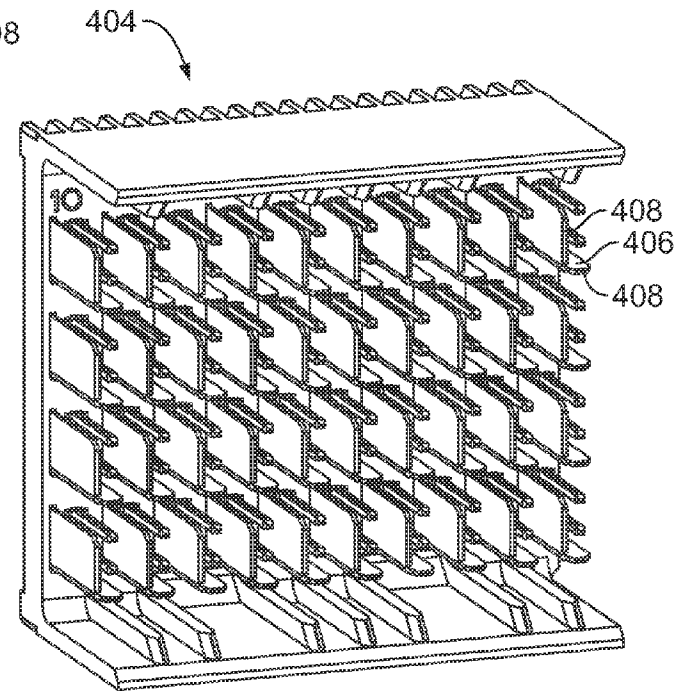
FIG. 8 is a front perspective view of an alternative header assembly formed in accordance with an exemplary embodiment.

FIG. 8 is a front perspective view of an alternative header assembly 404 formed in accordance with an exemplary embodiment. The header assembly 404 is similar to the header assembly 104 (shown in FIG. 1), however the header assembly includes L-shaped header ground contacts 406 rather than the C-shaped header ground contacts 146 (shown in FIG. 1). Other shaped header ground contacts are possible in alternative embodiments. The header ground contacts 406 have front edges 408 that are configured to engage a conductive gasket (not shown) held by a corresponding receptacle assembly (not shown).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing having signal contact openings and ground contact openings;

contact modules coupled to the front housing, the contact modules having a plurality of signal contacts received in corresponding signal contact openings of the front housing, the signal contacts being configured to be mated with corresponding signal contacts of a header assembly, the contact modules having shield bodies providing electrical shielding for the signal contacts, the shield bodies having mating interfaces; and a conductive gasket positioned between the front housing and at least one of the contact modules, the conductive gasket engaging the mating interface of at least one of the contact modules, the conductive gasket being configured to provide a ground path between the at least one of the contact modules and a ground contact of the header assembly which is configured to extend through the ground contact opening to directly engage the conductive gasket.

2. The receptacle assembly of claim 1, wherein the conductive gasket is planar having a first side and a second side, the first side engaging the mating interface of the at least one of the contact modules, the second side being configured to engage the ground contact of the header assembly.

3. The receptacle assembly of claim 1, wherein the conductive gasket is compressible between the at least one of the contact modules and the ground contact of the header assembly.

4. The receptacle assembly of claim 1, wherein the conductive gasket is securely held between the front housing and the mating interface of the at least one of the contact modules.

5. The receptacle assembly of claim 1, wherein the contact modules hold the signal contacts in differential pairs, the conductive gasket having openings therethrough with differential pairs of the signal contacts being received in corresponding openings of the conductive gasket.

6. The receptacle assembly of claim 1, wherein the contact modules include conductive holders holding dielectric frames, the dielectric frames holding the signal contacts, the conductive holders defining the shield body and providing shielding around the signal contacts, a front end of the conductive holders defining the mating interface and engaging the conductive gasket.

7. The receptacle assembly of claim 1, wherein the conductive gasket is attached to one of the front housing or the at least one of the contact modules prior to the contact modules being loaded into the front housing.

8. The receptacle assembly of claim 1, wherein the receptacle assembly includes a plurality of the conductive gaskets each being attached to corresponding contact modules.

9. An electrical connector assembly comprising:

a header assembly having a header housing holding header signal contacts and header ground contacts, the header ground contacts having front edges; and a receptacle assembly mated with the header assembly, the receptacle assembly comprising a contact module having receptacle signal contacts mated with corresponding header signal contacts, the contact module having a shield body providing electrical shielding for the receptacle signal contacts, the shield body having a mating interface, the receptacle assembly having a conductive gasket having a first side and a second side, the first side engaging the mating interface of the shield body, the second side engaging the front edges of the header ground contacts, wherein the conductive gasket provides a ground path between the contact module and the header ground contacts.

10. The electrical connector assembly of claim 9, wherein the conductive gasket is planar and compressible.

11. The electrical connector assembly of claim 9, wherein the header ground conductors are non-planar and extend along at least two sides of the header signal contacts and receptacle signal contacts.

12. The electrical connector assembly of claim 9, wherein the contact module holds the receptacle signal contacts in differential pairs, the conductive gasket having openings therethrough with differential pairs of the receptacle signal contacts being received in corresponding openings of the conductive gasket.

13. An electrical connector assembly comprising:

a header assembly having a header housing holding header signal contacts and header ground contacts; and a receptacle assembly mated with the header assembly, the receptacle assembly comprising:

contact modules having a plurality of receptacle signal contacts, the contact modules having shield bodies providing electrical shielding for the receptacle signal contacts, the shield bodies having mating interfaces;

a front housing holding the contact modules, the front housing having signal contact openings receiving the receptacle signal contacts and the header signal contacts, the receptacle signal contacts being mated with corresponding header signal contacts within the front housing, the front housing having ground contact openings receiving corresponding header ground contacts; and at least one conductive gasket positioned between the front housing and the contact module, the at least one conductive gasket engaging corresponding mating interfaces of the shield bodies of at least one of the contact modules and corresponding header ground contacts engaging the conductive gasket, wherein the at least one conductive gasket provides a ground path between the contact modules and corresponding header ground contacts.

14. The electrical connector assembly of claim 13, wherein the header ground contacts extend through the ground contact openings to directly engage the at least one conductive gasket.

15. The electrical connector assembly of claim 13, wherein the header ground conductors are C-shaped extending along three sides of the header signal contacts and receptacle signal contacts, the header ground contacts having a front edge, the front edge engaging the conductive gasket.

16. The electrical connector assembly of claim 13, wherein the at least one conductive gasket is planar having a first side and a second side, the first side engaging the mating interface of the at least one of the contact modules, the second side being configured to engage corresponding header ground contacts.

17. The electrical connector assembly of claim 13, wherein the at least one conductive gasket is compressible between the corresponding contact module and the header ground contacts.

18. The electrical connector assembly of claim 13, wherein the conductive gasket is securely held between the front housing and the mating interfaces of the shield bodies of the at least one of the contact modules.

19. The electrical connector assembly of claim 13, wherein the contact modules hold the receptacle signal contacts in differential pairs, the conductive gasket having openings therethrough with differential pairs of the receptacle signal contacts being received in corresponding openings of the conductive gasket.

20. The electrical connector assembly of claim 13, wherein the contact modules include conductive holders holding contact frames, the contact frames holding the receptacle signal contacts, the conductive holder defining the shield body and providing shielding for the receptacle signal contacts, a front end of the conductive holder defining the mating interface and engaging the conductive gasket.

* * * * *